US007761019B2

(12) United States Patent
Nakaso

(10) Patent No.: US 7,761,019 B2
(45) Date of Patent: Jul. 20, 2010

(54) IMAGE FORMING APPARATUS AND METHOD OF DETERMINING TRANSFER VOLTAGE THEREOF

(75) Inventor: Koji Nakaso, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1150 days.

(21) Appl. No.: 11/365,582

(22) Filed: Mar. 2, 2006

(65) Prior Publication Data

US 2006/0198650 A1 Sep. 7, 2006

(30) Foreign Application Priority Data

Mar. 4, 2005 (JP) ..... 2005-060206

(51) Int. Cl.
*G03G 15/20* (2006.01)

(52) U.S. Cl. ..... 399/66

(58) Field of Classification Search ..... 399/66, 399/314

See application file for complete search history.

(56) References Cited

U.S. PATENT DOCUMENTS 6,792,219 B2 * 9/2004 Hisada ..... 399/66 X
6,804,481 B2 * 10/2004 Mochizuki et al. ..... 399/66

FOREIGN PATENT DOCUMENTS

JP 11-161057 6/1999

* cited by examiner

*Primary Examiner*—Stephen D Meier
*Assistant Examiner*—Erika Villaluna
(74) *Attorney, Agent, or Firm*—Kubotera & Associates LLC

(57) ABSTRACT

An image forming apparatus includes: an image supporting member; a transfer member for transferring a developer image formed on the image supporting member to a medium; a current supply unit for supplying a detection current to the transfer member; a voltage detection unit for detecting a voltage generated in the transfer member when the detection current is supplied thereto; a comparison unit for comparing the generated voltage and a switch voltage selected according to the detection current; and a transfer voltage determining unit for determining a transfer voltage according to the generated voltage.

19 Claims, 9 Drawing Sheets

IMAGE FORMING APPARATUS AND METHOD OF DETERMINING TRANSFER VOLTAGE THEREOF

BACKGROUND OF THE INVENTION AND RELATED ART STATEMENT

The present invention relates to an image forming apparatus and a method of determining a transfer voltage to be supplied to a transfer member of the image forming apparatus.

In a conventional image forming device of an electric photography type such as a printer, a copier, and a facsimile, a charge roller charges a surface of a photosensitive drum. An exposure device exposes the photosensitive drum to form a static latent image thereon. A developing device develops the static latent image to form a toner image. A transfer roller transfers the toner image to a sheet as a medium.

A resistance of the transfer roller varies according to an environmental change such as a temperature change and a humidity change, and a change in the transfer roller itself with time. Therefore, it is necessary to adjust a voltage applied to the transfer roller according to such a change.

In a conventional contact-type charge device disclosed in Patent Reference, a specific detection current is supplied to a transfer roller for detecting a resistance of the transfer roller. A transfer voltage to be applied to the transfer roller is determined based on a voltage generated in the transfer roller.

Patent Reference: Japanese Patent Publication No. 11-161057

When a temperature or humidity increases, the resistance of the transfer roller decreases. In the conventional image forming apparatus, when the detection current is supplied to the transfer roller at a high temperature or humidity, the voltage generated in the transfer roller tends to decrease. Accordingly, it is difficult to detect the resistance with high accuracy and determine an optimal transfer voltage based on the resistance.

To this end, it is necessary to increase the detection current. However, when a temperature or humidity decreases, the resistance of the transfer roller increases. In such a case, when the detection current is supplied to the transfer roller at a low temperature or low humidity, a transfer shock may occur in a photosensitive drum.

In view of the problems described above, an object of the present invention is to provide an image forming apparatus, in which it is possible to determine an optimal transfer voltage and prevent a transfer shock from occurring in a photosensitive drum or an image supporting member. Another object of the present invention is to provide a method of determining a transfer voltage to be supplied to a transfer member of the image forming apparatus.

Further objects and advantages of the invention will be apparent from the following description of the invention.

SUMMARY OF THE INVENTION

In order to attain the objects described above, according to the present invention, an image forming apparatus comprises: an image supporting member; a transfer member for transferring a developer image formed on the image supporting member to a medium; a current supply unit for supplying a detection current to the transfer member; a voltage detection unit for detecting a voltage generated in the transfer member when the detection current is supplied thereto; a comparison unit for comparing the generated voltage and a switch voltage selected according to the detection current; and a transfer voltage determining unit for determining a transfer voltage according to the generated voltage.

According to the present invention, the current supply unit switches the detection current according to a comparison result of the comparison unit.

In the present invention, the image forming apparatus comprises: the image supporting member; the transfer member for transferring the developer image formed on the image supporting member to the medium; the current supply unit for supplying the detection current to the transfer member; the voltage detection unit for detecting the voltage generated in the transfer member when the detection current is supplied thereto; the comparison unit for comparing the generated voltage and the switch voltage selected according to the detection current; and the transfer voltage determining unit for determining the transfer voltage according to the generated voltage. Further, the current supply unit switches the detection current according to the comparison result of the comparison unit.

In particular, upon supplying the detection current to the transfer member, the generated voltage is compared with the switch voltage selected according to the detection current. The detection current is switched according to the comparison result. Accordingly, when a resistance of the transfer member is changed due to a change in an environment or time, it is possible to determine an optimal transfer voltage according to the resistance. Further, it is possible to prevent a transfer shock from occurring in the image supporting member.

DETAILED DESCRIPTION OF PREFERRED EMBODIMENTS

Hereunder, embodiments of the present invention will be explained with reference to the accompanying drawings. In the embodiments, a monochrome printer is provided as an image forming apparatus.

Figure 2:
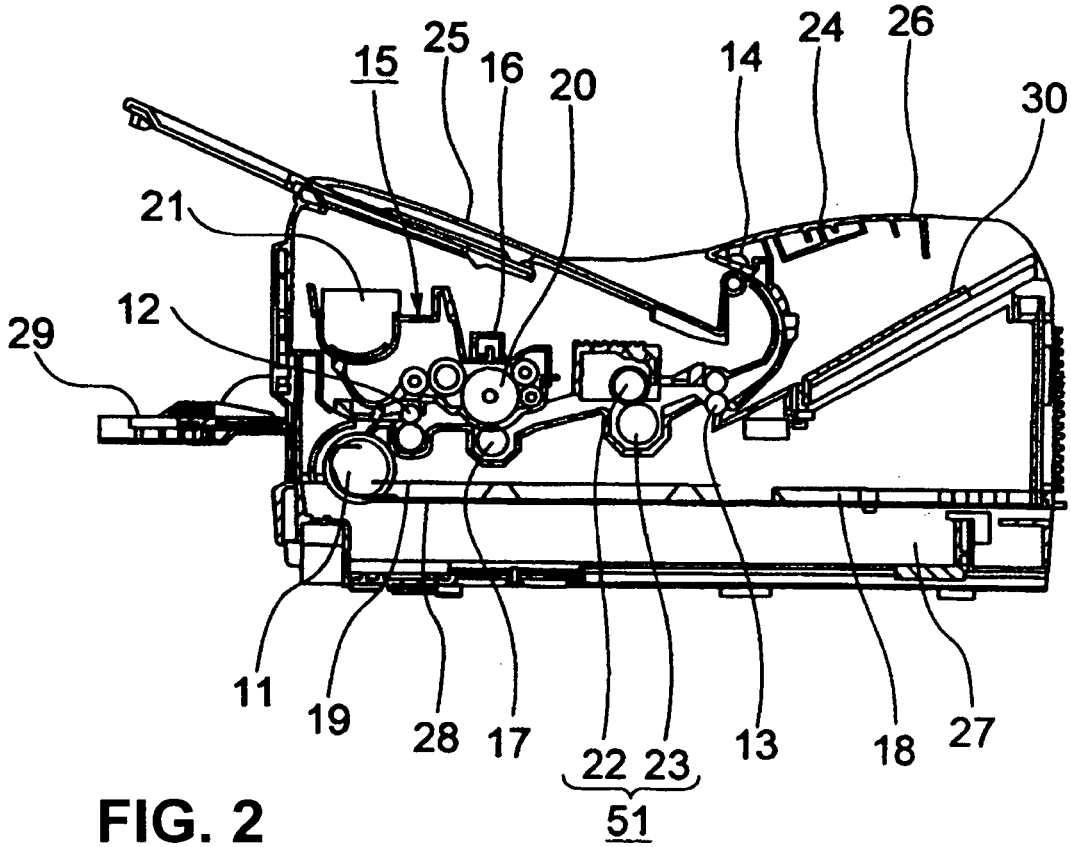
FIG. 2 is a schematic view showing the printer according to the first embodiment of the present invention.
Figure 3:
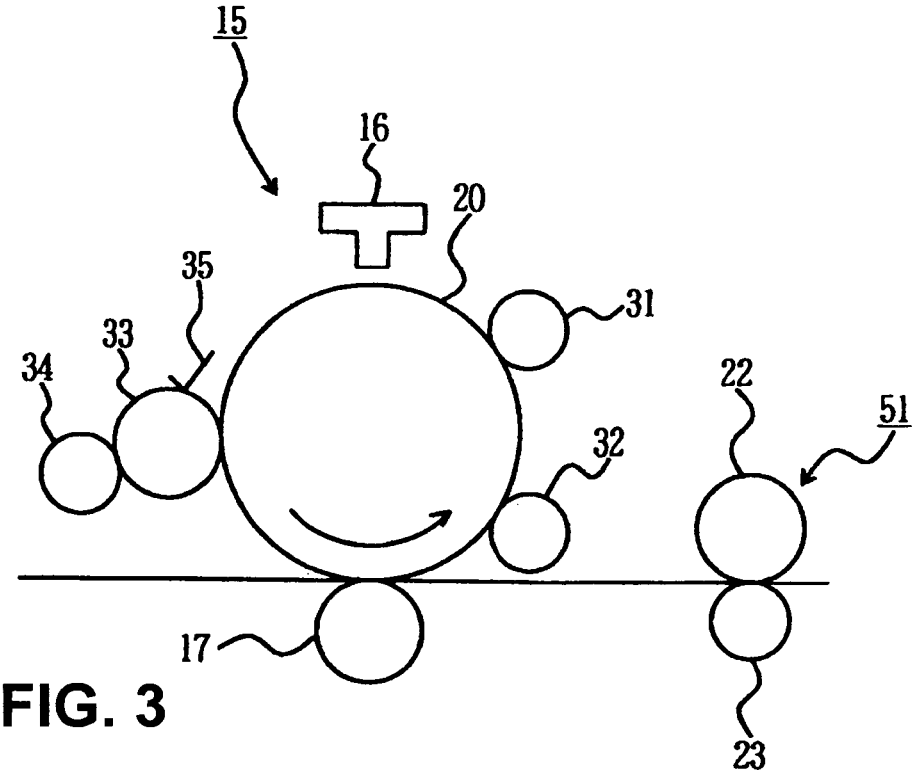
FIG. 3 is a schematic view showing an electric photography process unit according to the first embodiment of the present invention.

FIG. 2 is a schematic view showing the printer according to a first embodiment of the present invention. FIG. 3 is a schematic view showing an electric photography process unit according to the first embodiment of the present invention.

As shown in FIGS. 2 and 3, the printer includes a sheet transport unit for transporting a sheet as a medium; an electric photography process unit for forming an image through an electric photography process; and a print control unit for controlling the printer as a whole.

The sheet transport unit includes a hopping roller 11; a register roller 12; and discharge rollers 13 and 14. The electric photography process unit includes an image drum cartridge 15 serving as an image forming unit; an LED array head 16 serving as an exposure device; a transfer roller 17 serving as a transfer device; and a fixing device 51. The print control unit includes a power source (not shown); a power source control board 18; and a high-voltage power source board 19.

The image drum cartridge 15 includes a photosensitive drum 20 serving as an image supporting member; a charge roller 31 serving as a charge device; a developing device; a toner cartridge 21 serving as a developer cartridge; and a cleaning roller 32 serving as a cleaning device. The fixing device 51 includes a heat roller 22 serving as a heating member, and a back-up roller 23 serving as a pressing member. The developing device includes a developing roller 33 serving as a developer supporting member for holding toner as developer; a toner supply roller 34 serving as a developer supply member for supplying toner to the developing roller 33; and a developing blade 35 for forming a thin layer of toner on a surface of the toner supply roller 34.

In the embodiment, the printer also includes an operation panel 24; a stack cover 25 for stacking sheets with images face down; an upper cover 26; a sheet cassette 27 serving as a medium storage unit; a base plate 28; a manual tray 29; and a stacker 30 for stacking sheets with images face up.

In the electric photography process unit, an image is formed according to the following six steps. In the first step, the charge roller 31 charges a surface of the photosensitive drum 20 uniformly. In the second step, the LED array head 16 exposes the surface of the photosensitive drum 20, so that a static latent image is formed as a latent image. In the third step, toner held on the developing roller 33 is attached to the photosensitive drum 20, so that the static latent image is developed to form a toner image as a developer image. In the fourth step, the transfer roller 17 transfers the toner image on a sheet. In the fifth step, the fixing device 51 fixes the toner image on the sheet. In the sixth step, the cleaning roller 32 removes toner remaining on the photosensitive drum 20 after the toner image is transferred.

Figure 1:
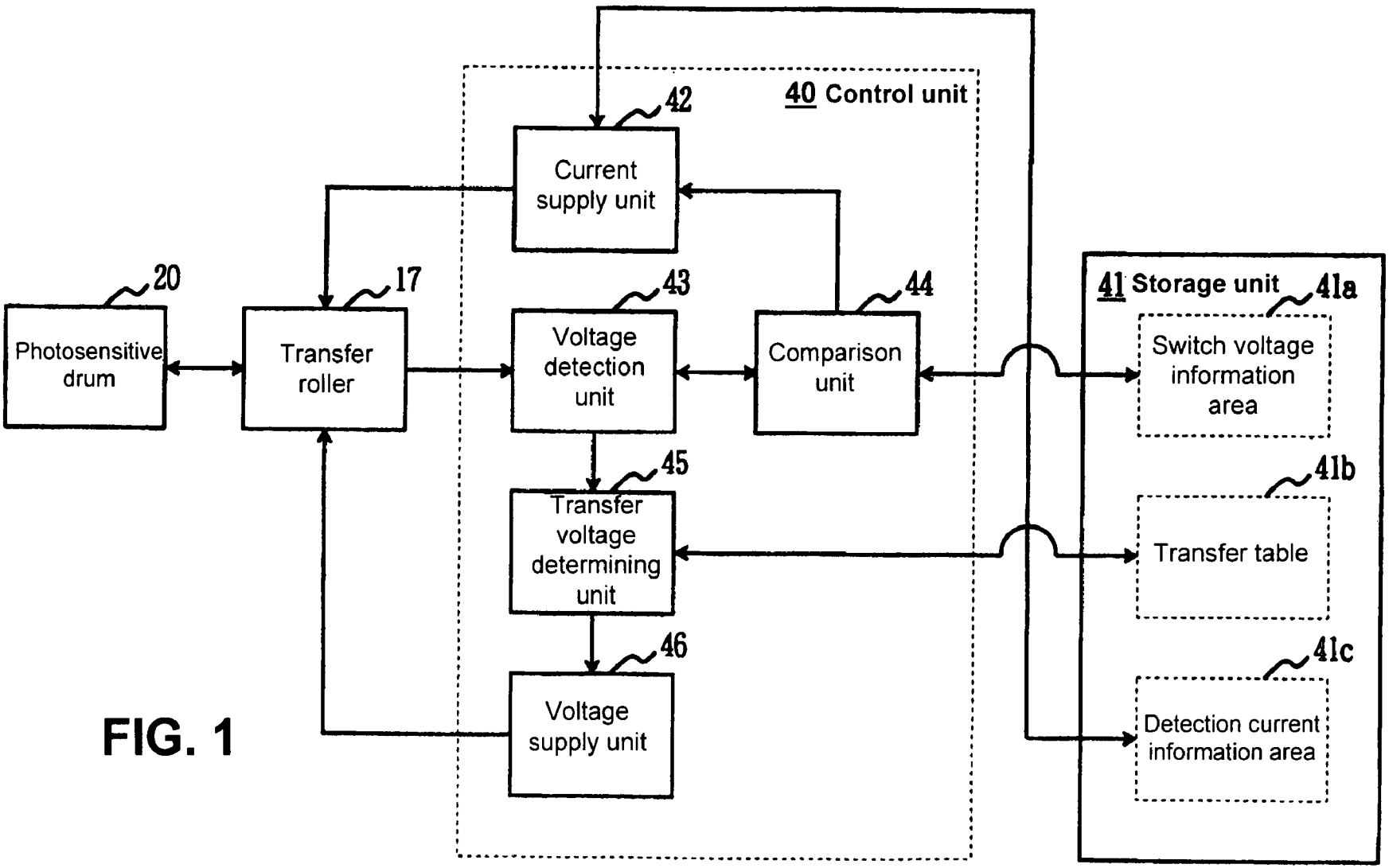
FIG. 1 is a block diagram showing a printer according to a first embodiment of the present invention.

FIG. 1 is a block diagram showing a printer according to the first embodiment of the present invention. As shown in FIG. 1, the printer includes the photosensitive drum 20; the transfer roller 17; a control unit 40; and a storage unit 41. The control unit 40 controls the printer as a whole, and also controls the transfer roller 17 to transfer a toner image formed on the photosensitive drum 20 to a sheet. The control unit 40 includes a current supply unit (current supply process unit) 42; a voltage detection unit (voltage detection process unit) 43; a comparison unit (comparison process unit) 44; a transfer voltage determining unit (transfer voltage determining process unit) 45; and a voltage supply unit (voltage supply process unit) 46.

The storage unit 41 includes a memory storing information necessary for the control unit 40 to control the transfer roller 17. The storage unit 41 also includes a switch voltage information area 41*a* for storing a switch voltage (voltage value) serving as a standard for switching a detection current used for detecting a resistance of the transfer roller 17; a transfer table 41*b* serving as a standard for determining a transfer voltage; and a detection current information area 41*c* for storing a detection current (current value) used in a previous operation.

The current supply unit 42 constitutes a constant current power source for supplying a detection current to the transfer roller 17 to detect a resistance of the transfer roller 17. The voltage detection unit 43 constitutes a voltage meter for detecting a voltage generated in the transfer roller 17 when the detection current is supplied thereto.

The comparison unit 44 compares the voltage detected by the voltage detection unit 43, i.e., a generated voltage, with a specific voltage, i.e., the switch voltage stored in the switch voltage information area 41*a* in the embodiment, so that it is determined whether the detection current is switched. The transfer voltage determining unit 45 refers to the transfer table 41*b* to determine and retrieve a transfer voltage corresponding to the generated voltage. The voltage supply unit 46 constitutes a constant voltage power source for supplying the transfer voltage determined by the transfer voltage determining unit 45 to the transfer roller 17.

Figure 6:
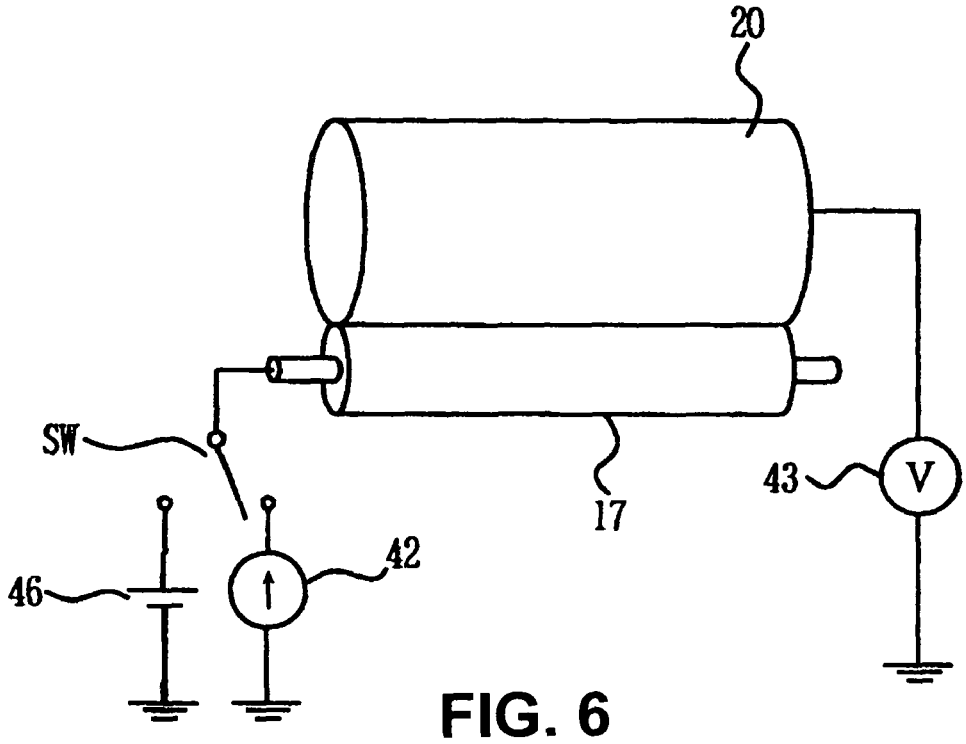
FIG. 6 is a schematic view showing a process of detecting a generated voltage according to the first embodiment of the present invention.
Figure 7:
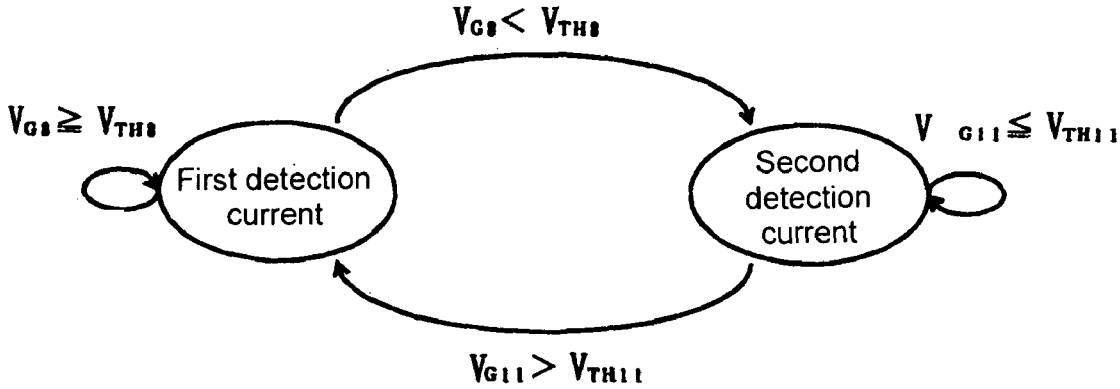
FIG. 7 is a schematic view showing a process of switching a detection current according to the first embodiment of the present invention.

An operation of the printer will be explained next. FIG. 6 is a schematic view showing a process of detecting a generated voltage according to the first embodiment of the present invention. FIG. 7 is a schematic view showing a process of switching a detection current according to the first embodiment of the present invention.

Figure 8:
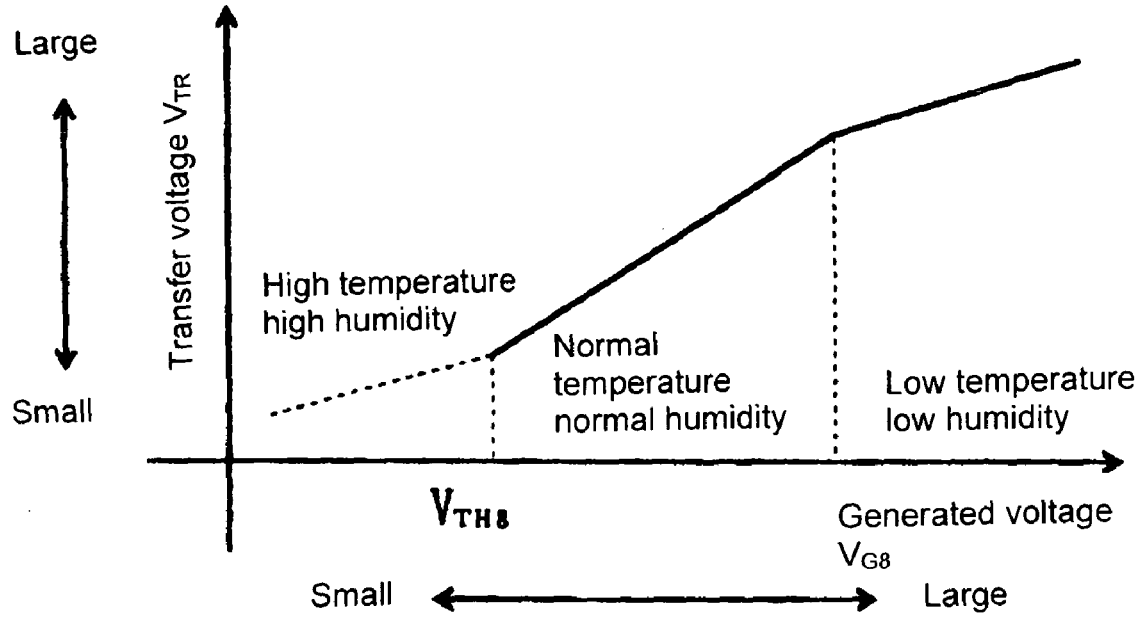
FIG. 8 is a graph showing a first detection current according to the first embodiment of the present invention.
Figure 9:
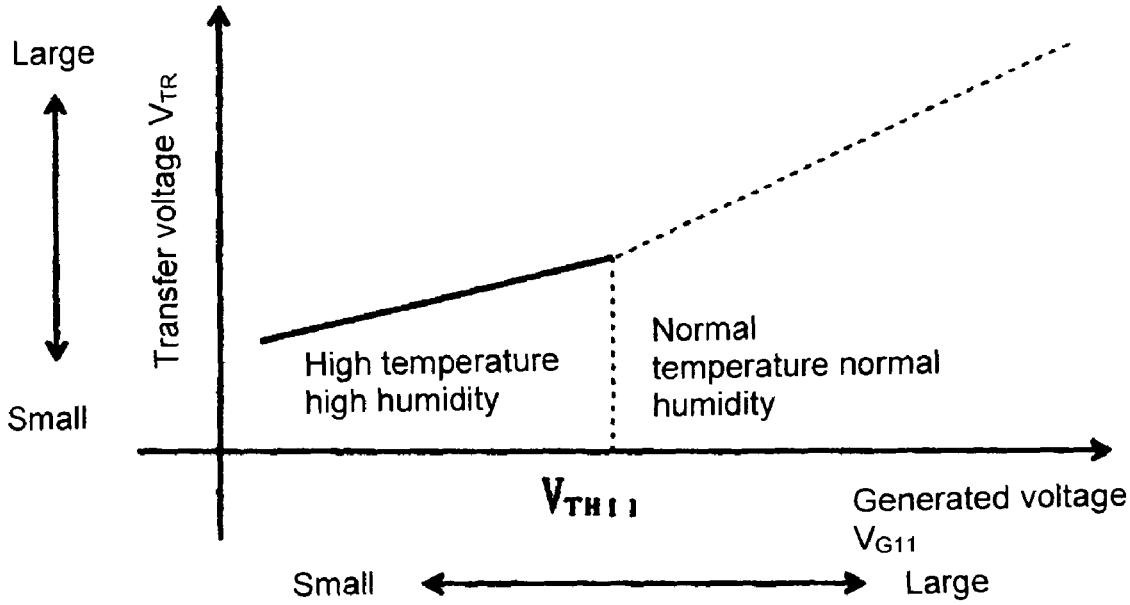
FIG. 9 is a graph showing a second detection current according to the first embodiment of the present invention.

FIG. 8 is a graph showing a first detection current according to the first embodiment of the present invention. FIG. 9 is a graph showing a second detection current according to the first embodiment of the present invention. In FIG. 8, the horizontal axis represents a generated voltage $V_{G8}$, and a vertical axis represents a transfer voltage $V_{TR}$. In FIG. 9, the horizontal axis represents a generated voltage $V_{G11}$, and a vertical axis represents the transfer voltage $V_{TR}$.

As shown in FIG. 6, there are provided the transfer roller 17; the photosensitive drum 20; the current supply unit 42; the voltage detection unit 43; the voltage supply unit 46; and a switch SW. When the control unit 40 receives a print signal from an upper device (not shown), the printer determines whether it is right after a power switch is turned on (power-on). In this case, a register is provided to reset upon the power-on. After the determination, a specific number is written in the register, so that it is possible to determine it is right after the power switch is turned on. When it is not right after the power switch is turned on, it is determined from the detection current information area 41*c* that the detection current used in a previous operation is a first detection current (8 μA) or a second detection current (11 μA). It is arranged such that the detection current is re-written every time the detection current is switched. Further, with a non-volatile memory and the like, the detection current is not erased when the current is cut off.

When it is right after the power switch is turned on, or the detection current used in a previous operation is the first detection current, the current supply unit 42 supplies the first detection current to the transfer roller 17, and the voltage detection unit 43 detects the generated voltage $V_{G8}$ generated in the transfer roller 17. Then, the comparison unit 44 compares the generated voltage $V_{G8}$ with a first switch voltage $V_{TH8}$ (400 V) retrieved from the switch voltage information area 41*a*. At this time, the comparison unit 44 refers to the switch voltage information area 41*a* to correspond the switch voltage to the detection current. In the embodiment, the comparison unit 44 corresponds the switch voltage to the first detection current, so that the first switch voltage $V_{TH8}$ is selected.

The first switch voltage $V_{TH8}$ will be explained next. The resistance of the transfer roller 17 decreases in a high temperature and high humidity environment. When the resistance is detected in such an environment, the generated voltage $V_{G8}$ generated in the transfer roller 17 may become too small upon supplying the first detection current to the transfer roller 17, thereby lowering resistance detection accuracy. The image forming apparatus may be used in a high temperature and high humidity environment, a normal temperature and normal humidity environment, or a low temperature and low humidity environment.

Accordingly, when the generated voltage $V_{G8}$ is smaller than a threshold value, the first detection current is switched to the second detection current having a value larger than that of the first detection current. Then, the second detection current is supplied to the transfer roller 17 for detecting the resistance thereof. The first switch voltage $V_{TH8}$ serves as the threshold value for switching from the first detection current to the second detection current.

As shown in FIG. 7, when the generated voltage $V_{G8}$ is larger than the first switch voltage $V_{TH8}$, the detection current is not switched. When the generated voltage $V_{G8}$ is smaller than the first switch voltage $V_{TH8}$, the detection current is switched to the second detection current, so that the current supply unit 42 supplies the second detection current to the transfer roller 17.

When it is not right after the power switch is turned on, and the detection current used in a previous operation is the second detection current, the current supply unit 42 supplies the second detection current to the transfer roller 17, and the voltage detection unit 43 detects the generated voltage $V_{G11}$ generated in the transfer roller 17. Then, the comparison unit 44 compares the generated voltage $V_{G11}$ with a second voltage $V_{TH11}$ (600 V) retrieved from the switch voltage information area 41*a*. At this time, the comparison unit 44 corresponds the switch voltage to the second detection current, so that the second switch voltage $V_{TH11}$ is selected.

The second switch voltage $V_{TH11}$ will be explained next. The resistance of the transfer roller 17 increases in a low temperature and low humidity environment. When the resistance is detected in such an environment, the generated voltage $V_{G11}$ generated in the transfer roller 17 may become too large upon supplying the second detection current to the transfer roller 17, thereby causing transfer shock to the photosensitive drum 20. Accordingly, when the generated voltage $V_{G11}$ is larger than a threshold value, the detection current is switched to the first detection current. Then, the first detection current is supplied to the transfer roller 17 for detecting the resistance thereof. The second switch voltage $V_{TH11}$ serves as the threshold value for switching from the second detection current to the first detection current.

As shown in FIG. 7, when the generated voltage $V_{G11}$ is smaller than the second switch voltage $V_{TH11}$, the detection current is not switched. When the generated voltage $V_{G11}$ is larger than the second switch voltage $V_{TH11}$, the detection current is switched to the first detection current, so that the current supply unit 42 supplies the first detection current to the transfer roller 17.

In the embodiment, the first switch voltage $V_{TH8}$ and the second switch voltage $V_{TH11}$ are set such that a resistance R2 is greater than a resistance R1 by 5 MΩ. In this case, the resistance R1 is a resistance of the transfer roller 17 generating the first switch voltage $V_{TH8}$ upon supplying the first detection current in an initial state. The resistance R2 is a resistance of the transfer roller 17 generating the second switch voltage $V_{TH11}$ upon supplying the second detection current in an initial state. When the resistance R1 has a value equal or very close to that of the resistance R2, it is necessary to switch the detection current even when the resistance of the transfer roller 17 slightly changes.

Afterwards, the voltage detection unit 43 detects the generated voltage $V_{G8}$ and the generated voltage $V_{G11}$ generated in the transfer roller 17. Then, the transfer voltage determining unit 45 retrieves a transfer table corresponding to the generated voltage $V_{G8}$ shown in FIG. 8 and a transfer table corresponding to the generated voltage $V_{G11}$ shown in FIG. 9 from the transfer table 41*b*. When the transfer tables corresponding to the first detection current (8 μA) and the second detection current (11 μA) are retrieved, the transfer voltage determining unit 45 refers to the retrieved transfer tables to determine the transfer voltage $V_{TR}$ corresponding to the generated voltage $V_{G8}$ and the generated voltage $V_{G11}$. Then, the voltage supply unit 46 applies the determined transfer voltage $V_{TR}$ to the transfer roller 17 for constant voltage control, and the control unit 40 starts a printing operation. When the printing operation is continuous, the voltage supply unit 46 continues the constant voltage control with the transfer voltage $V_{TR}$. The used detection current is stored in the detection current information area 41*c*, thereby completing the printing operation.

In the embodiment, the detection current is supplied to the transfer roller 17 for determining the transfer voltage $V_{TR}$ before a sheet arrives between the transfer roller 17 and the photosensitive drum 20. Accordingly, it is possible to smoothly transfer an image to the sheet even at a high printing speed.

As described above, in the embodiment, it is possible to switch the detection current for detecting the resistance of the transfer roller 17. Accordingly, when the resistance of the transfer roller is changed due to a change in an environment or time, it is possible to determine an optimal transfer voltage according to the resistance. Further, it is possible to prevent a transfer shock from occurring in the photosensitive drum 20.

Figure 4:
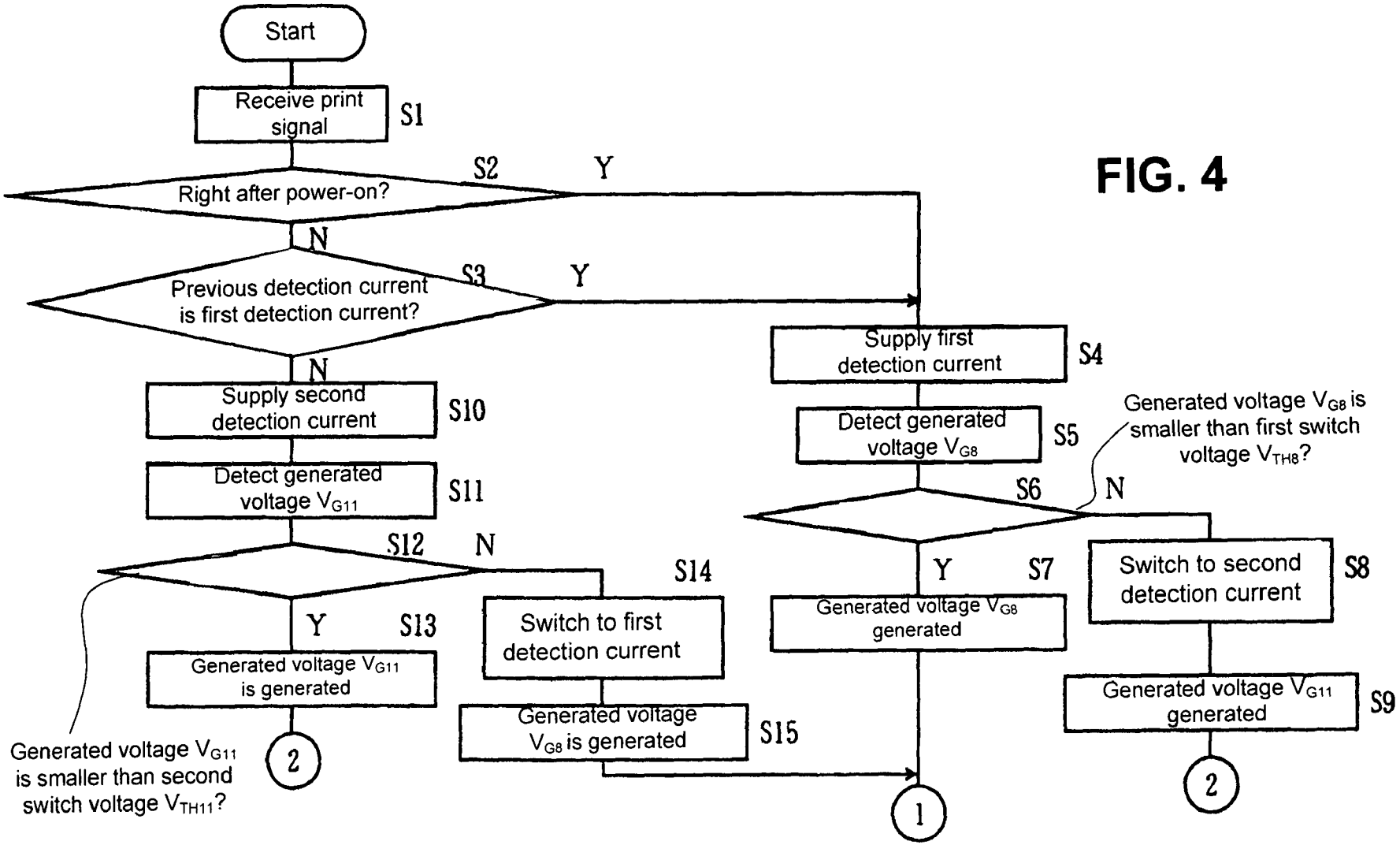
FIG. 4 is a flow chart No. 1 showing an operation of the printer according to the first embodiment of the present invention.
Figure 5:
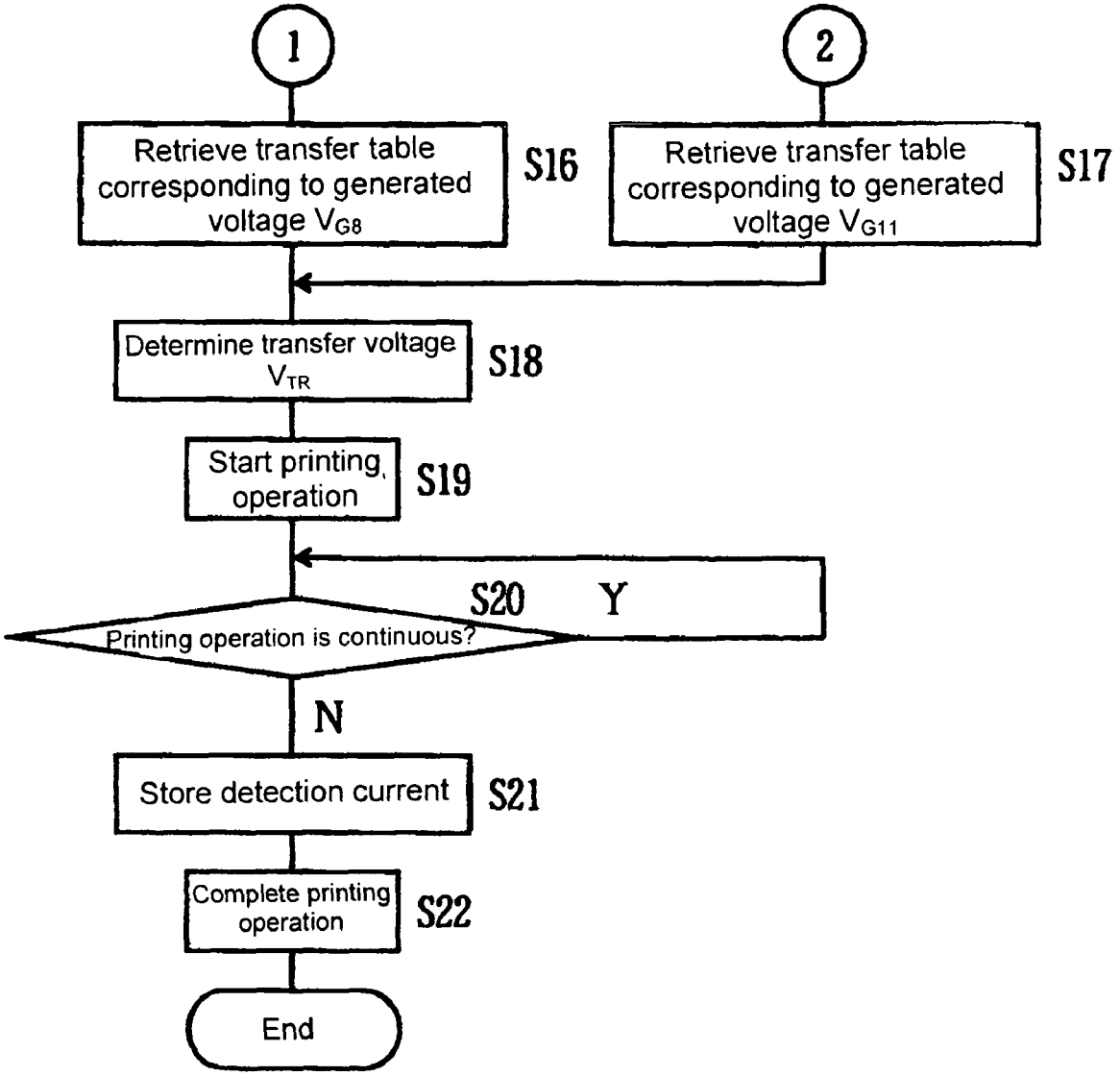
FIG. 5 is a flow chart No. 2 showing an operation of the printer according to the first embodiment of the present invention.

The operation of the printer will be explained with refer to flow charts shown in FIGS. 4 and 5. FIG. 4 is a flow chart No. 1 showing an operation of the printer according to the first embodiment of the present invention. FIG. 5 is a flow chart No. 2 showing an operation of the printer according to the first embodiment of the present invention.

In step S1, the print signal is received. In step S2, it is determined whether it is right after the power-on. When it is right after the power-on, the process proceeds to step S4. When it is not right after the power-on, the process proceeds to step S3. In step S3, it is determined whether the detection current used in a previous operation is the first detection current. When the detection current used in a previous operation is the first detection current, the process proceeds to step S4. When the detection current used in a previous operation is not the first detection current, the process proceeds to step S10.

In step S4, the first detection current is supplied. In step S5, the generated voltage $V_{G8}$ is detected. In step S6, it is determined whether the generated voltage $V_{G8}$ is smaller than the first switch voltage $V_{TH8}$. When the generated voltage $V_{G8}$ is greater than the first switch voltage $V_{TH8}$, the process proceeds to step S7. When the generated voltage $V_{G8}$ is smaller than the first switch voltage $V_{TH8}$, the process proceeds to step S8. In step S7, the generated voltage $V_{G8}$ is generated. In step S8, the detection current is switched to the second detection current. In step S9, the generated voltage $V_{G11}$ is generated. In step S10, the second detection current is supplied.

In step S11, the generated voltage $V_{G11}$ is detected. In step S12, it is determined whether the generated voltage $V_{G11}$ is smaller than the second switch voltage $V_{TH11}$. When the generated voltage $V_{G11}$ is smaller than the second switch voltage $V_{TH11}$, the process proceeds to step S13. When the generated voltage $V_{G11}$ is greater than the second switch voltage $V_{TH11}$, the process proceeds to step S14. In step S13, the generated voltage $V_{G11}$ is generated. In step S14, the detection current is switched to the first detection current. In step S15, the generated voltage $V_{G8}$ is generated.

In step S16, the transfer table corresponding to the generated voltage $V_{G8}$ is retrieved. In step S17, the transfer table corresponding to the generated voltage $V_{G11}$ is retrieved. In step S18, the transfer voltage $V_{TR}$ is determined. In step S19, the printing operation is started. In step S20, it is determined whether the printing operation is continuous. When the printing operation is continuous, the process returns to step S20. When the printing operation is not continuous, the process proceeds to step S21. In step S21, the detection current is stored. In step S22, the printing operation is completed.

In the first embodiment, it is necessary to detect the generated voltage twice for detecting the resistance, thereby making the operation cumbersome. In a second embodiment, it is possible to detect the resistance of the transfer roller 17 with a simple operation. In the second embodiment, components same as those in the first embodiment are designated by the same reference numerals, and explanations thereof are omitted. It is noted that the components same as those in the first embodiment have the same effects.

Figure 10:
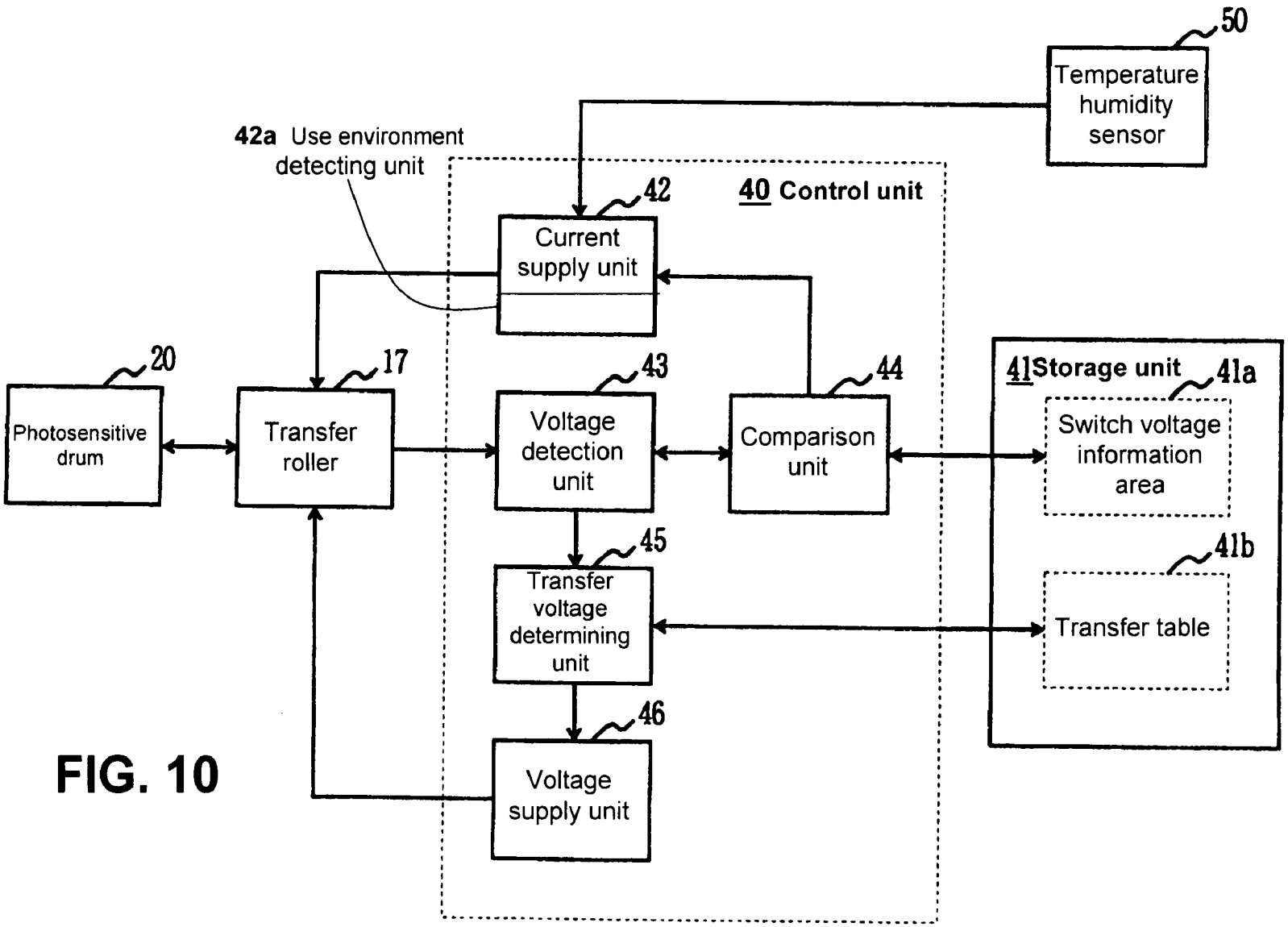
FIG. 10 is a block diagram showing a printer according to a second embodiment of the present invention.

FIG. 10 is a block diagram showing a printer according to the second embodiment of the present invention. As shown in FIG. 10, the printer includes a temperature-humidity sensor 50 for estimating a use environment as an environment detection unit. The temperature-humidity sensor 50 detects a temperature and a humidity of a location where the printer is placed.

Figure 11:
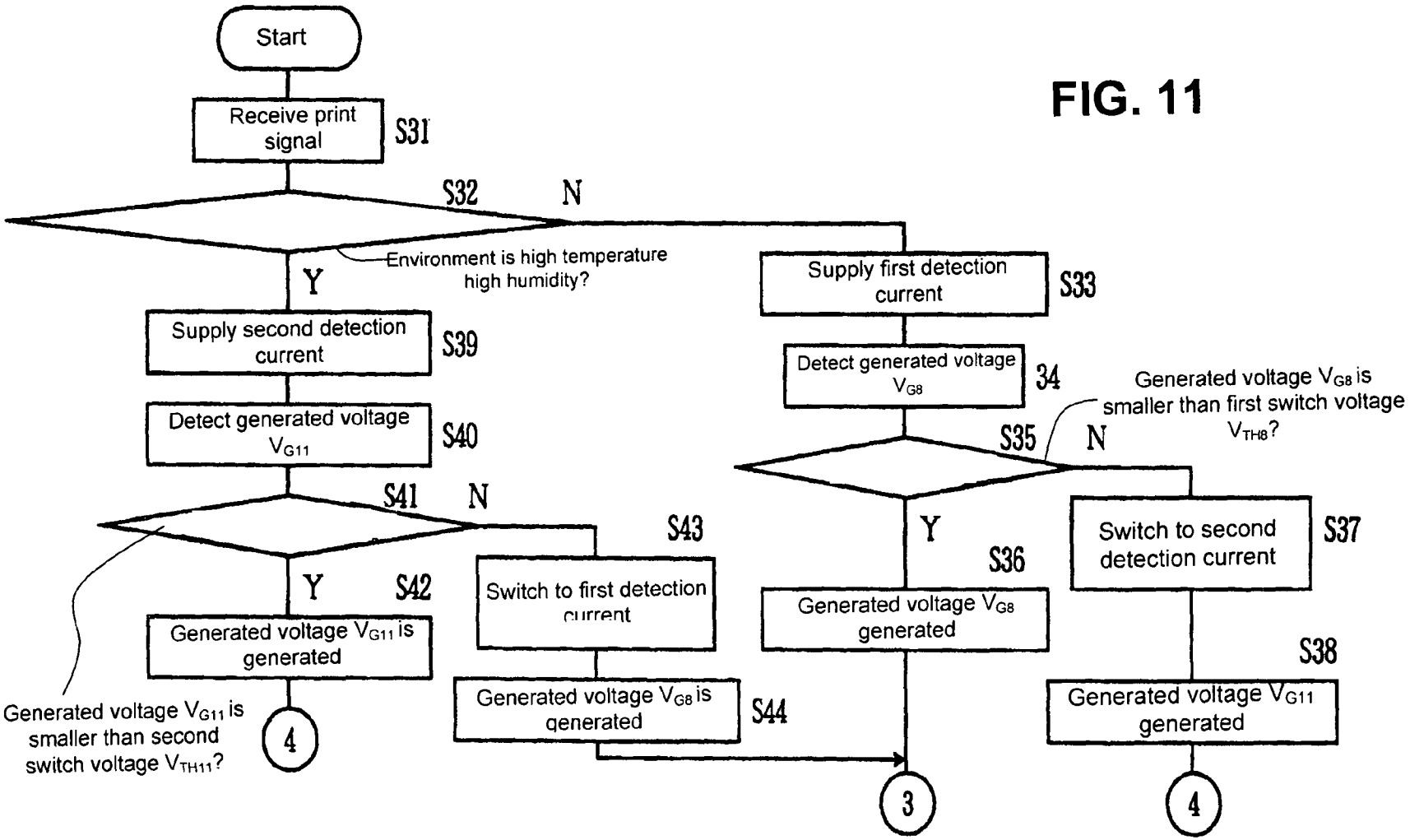
FIG. 11 is a flow chart No. 1 showing an operation of the printer according to the second embodiment of the present invention.
Figure 12:
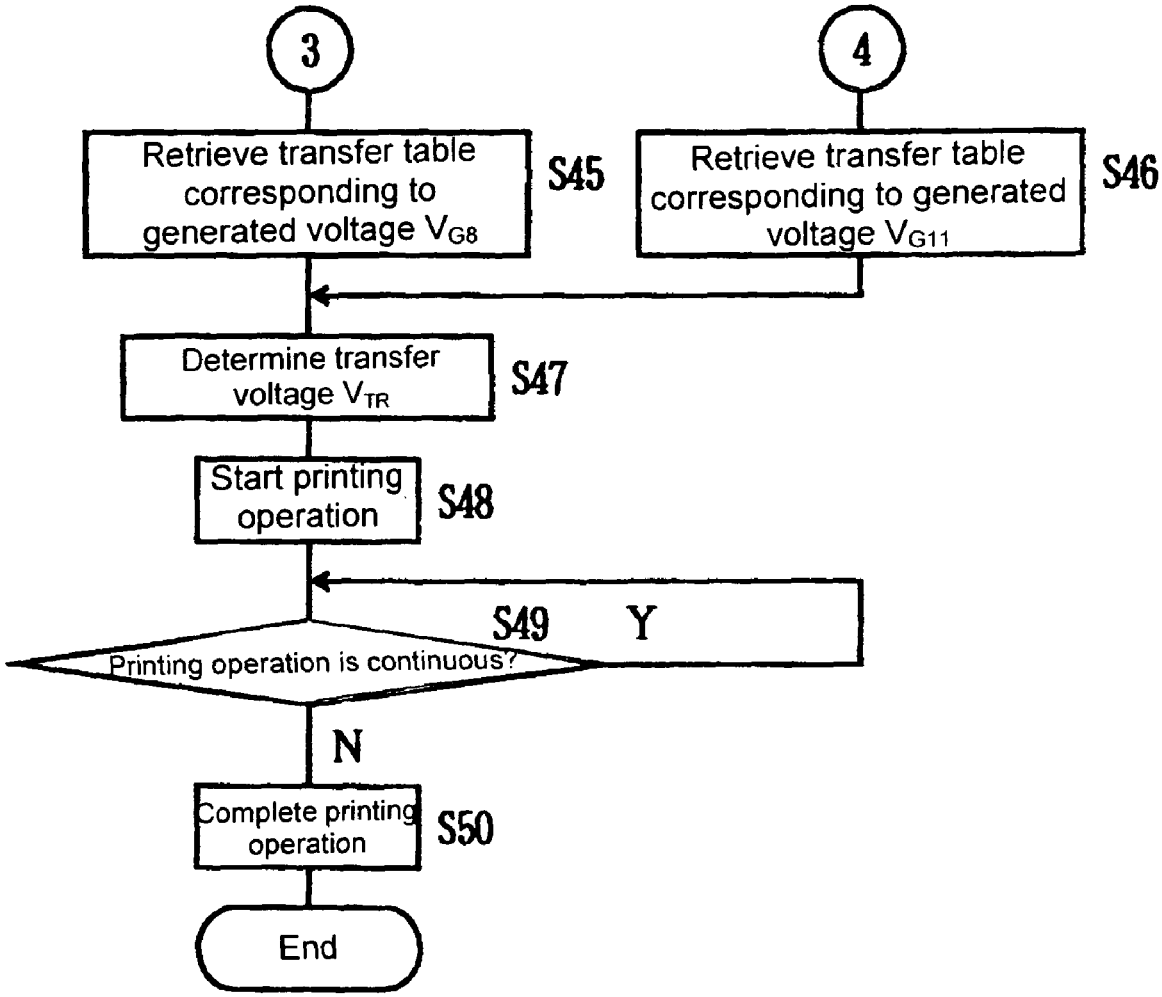
FIG. 12 is a flow chart No. 2 showing an operation of the printer according to the second embodiment of the present invention.

An operation of the printer will be explained next. FIG. 11 is a flow chart No. 1 showing an operation of the printer according to the second embodiment of the present invention. FIG. 12 is a flow chart No. 2 showing an operation of the printer according to the second embodiment of the present invention.

In the second embodiment, when the control unit 40 receives the print signal, a use environment determining unit 42*a* in the current supply unit 42 performs a use environment determining process. In the use environment determining process, the temperature-humidity sensor 50 detects a temperature and humidity, and the use environment determining unit reads the temperature and the humidity to determine whether a use environment is under a high temperature and high humidity. In the embodiment, threshold values of temperature and humidity are used for determining whether the use environment is under high temperature and high humidity. The threshold values are empirically determined in advance according to a material of the transfer roller 17 and the like. In the embodiment, for example, when a temperature is above 40° C. and a humidity is above 80%, it is determined that the use environment is under high temperature and high humidity.

When it is determined that the use environment is under high temperature and high humidity, the current supply unit 42 presumes that the transfer roller 17 has a large resistance and increases the detection current, so that the second detection current is supplied to the transfer roller 17. When it is determined that the use environment is not under high temperature and high humidity, the current supply unit 42 presumes that the transfer roller 17 has a small resistance and decreases the detection current, so that the first detection current is supplied to the transfer roller 17.

In the embodiments, the detection current is switched according to the generated voltage. Accordingly, it is possible to cope with the change of the transfer roller 17 with time. In this case, the detection current is not switched according to the generated voltage so often. In the first embodiment, the detection current used in the process is stored in the detection current information area 41*c*. In the second embodiment, the detection current is determined based on the detection result of the temperature-humidity sensor 50, and it is not necessary to provide the detection current information area 41*c*.

As described above, in the second embodiment, it is possible to detect the resistance of the transfer roller 17 through detecting the generated voltage just once, thereby making the operation simple.

The operation of the printer will be explained with refer to flow charts shown in FIGS. 11 and 12. FIG. 11 is a flow chart No. 1 showing an operation of the printer according to the second embodiment of the present invention. FIG. 12 is a flow chart No. 2 showing an operation of the printer according to the second embodiment of the present invention.

In step S31, the print signal is received. In step S32, it is determined whether a use environment is under a high temperature and high humidity. When the use environment is under a high temperature and high humidity, the process proceeds to step S39. When the use environment is not under a high temperature and high humidity, the process proceeds to step S33. In step S33, the first detection current is supplied. In step S34, the generated voltage $V_{G8}$ is detected. In step S35, it is determined whether the generated voltage $V_{G8}$ is smaller than the first switch voltage $V_{TH8}$. When the generated voltage $V_{G8}$ is greater than the first switch voltage $V_{TH8}$, the process proceeds to step S36. When the generated voltage $V_{G8}$ is smaller than the first switch voltage $V_{TH8}$, the process proceeds to step S37.

In step S36, the generated voltage $V_{G8}$ is generated. In step S37, the detection current is switched to the second detection current. In step S38, the generated voltage $V_{G11}$ is generated. In step S39, the second detection current is supplied. In step S40, the generated voltage $V_{G11}$ is detected. In step S41, it is determined whether the generated voltage $V_{G11}$ is smaller than the second switch voltage $V_{TH11}$. When the generated voltage $V_{G11}$ is smaller than the second switch voltage $V_{TH11}$, the process proceeds to step S42. When the generated voltage $V_{G11}$ is greater than the second switch voltage $V_{TH11}$, the process proceeds to step S43. In step S42, the generated voltage $V_{G11}$ is generated. In step S43, the detection current is switched to the first detection current. In step S44, the generated voltage $V_{G8}$ is generated.

In step S45, the transfer table corresponding to the generated voltage $V_{G8}$ is retrieved. In step S46, the transfer table corresponding to the generated voltage $V_{G11}$ is retrieved. In step S47, the transfer voltage $V_{TR}$ is determined. In step S48, the printing operation is started. In step S49, it is determined whether the printing operation is continuous. When the printing operation is continuous, the process returns to step S49. When the printing operation is not continuous, the process proceeds to step S50. In step S50, the printing operation is completed.

In the embodiments described above, the image forming apparatus is the monochrome printer, and may include a multiple-color printer. The present invention is not limited to the embodiments described above, and various modifications are possible within a scope of the present invention.

The disclosure of Japanese Patent Application No. 2005-060206, filed on Mar. 4, 2005, is incorporated in the application.

While the invention has been explained with reference to the specific embodiments of the invention, the explanation is illustrative and the invention is limited only by the appended claims.

What is claimed is:

1. An image forming apparatus, comprising:

an image supporting member;

a transfer member for transferring a developer image formed on the image supporting member to a medium;

a current supply unit for supplying a detection current to the transfer member;

a voltage detection unit for detecting a generated voltage generated in the transfer member when the detection current is supplied to the transfer member;

a comparison unit for comparing the generated voltage with a specific threshold value;

a detection current switching unit for determining to switch the detection current according to a comparison result of the comparison unit so that the voltage detection unit detects the generated voltage one more time when the detection current switching unit switches the detection current; and a transfer voltage determining unit for determining a transfer voltage according to the generated voltage.

2. The image forming apparatus according to claim 1, further comprising a storage unit for storing the detection current used in a previous operation so that the current supply unit retrieves the detection current used in the previous operation and supplies the detection current to the transfer member.

3. The image forming apparatus according to claim 1, further comprising a use environment determining unit for determining a use environment of the image forming apparatus so that the current supply unit determines the detection current in an initial state based on the determined use environment.

4. The image forming apparatus according to claim 1, wherein said transfer voltage determining unit determines the transfer voltage before the medium arrives between the image supporting member and the transfer member.

5. An image forming apparatus, comprising:

an image supporting member;

a transfer member for transferring a developer image formed on the image supporting member to a medium;

a selection unit for selecting one of a first detection current and a second detection current;

a current supply unit for supplying the one of the first detection current and the second detection current to the transfer member;

a voltage detection unit for detecting a generated voltage generated in the transfer member when the one of the first detection current and the second detection current is supplied to the transfer member;

a comparison unit for comparing the generated voltage and a specific voltage;

a detection current switching unit for determining to switch between the first detection current and the second detection current according to a comparison result of the comparison unit so that the voltage detection unit detects the generated voltage one more time when the second detection current is supplied to the transfer member when the detection current switching unit switches the first detection current to the second detection current, and the voltage detection unit detects the generated voltage one more time when the first detection current is supplied to the transfer member when the detection current switching unit switches the second detection current to the first detection current; and a control unit for controlling the current supply unit and determining a transfer voltage according to the generated voltage.

6. The image forming apparatus according to claim 5, wherein said control unit controls the current supply unit to supply the other of the first detection current and the second detection current to the transfer member when the comparison unit generates a specific comparison result.

7. A method of determining a transfer voltage to be supplied to a transfer member of an image forming apparatus, comprising the steps of:

selecting one of a first detection current and a second detection current according to a predetermined condition;

supplying the one of the first detection current and the second detection current to the transfer member;

detecting a generated voltage generated in the transfer member when the one of the first detection current and the second detection current is supplied to the transfer member;

comparing the generated voltage with a specific threshold value;

determining to switch between the first detection current and the second detection current according to a comparison result between the generated voltage and the specific threshold value;

detecting the generated voltage one more time when the second detection current is supplied to the transfer member when the first detection current is switched to the second detection current;

detecting the generated voltage one more time when the first detection current is supplied to the transfer member when the second detection current is switched to the first detection current; and determining the transfer voltage based on the generated voltage.

8. The method of determining a transfer voltage according to claim 7, further comprising the step of determining whether the first detection current is used in a previous operation so that the first detection current is selected when the first detection current is used in the previous operation.

9. The method of determining a transfer voltage according to claim 7, further comprising the step of determining whether it is right after the image forming apparatus is turned on so that the first detection current is selected when it is right after the image forming apparatus is turned on.

10. The method of determining a transfer voltage according to claim 7, further comprising the step of switching from the one of the first detection current and the second detection current to the other of the first detection current and the second detection current so that the other of the first detection current and the second detection current is supplied to the transfer member.

11. The method of determining a transfer voltage according to claim 10, wherein, in the step of switching between the first detection current and the second detection current, the first detection current and the second detection current are switched according to one of a first switch voltage generated in the transfer member having a first resistance when the first detection current is supplied thereto and a second switch voltage generated in the transfer member having a second resistance when the second detection current is supplied thereto.

12. The method of determining a transfer voltage according to claim 11, further comprising the step of setting the first switch voltage and the second switch voltage in advance such that the first resistance is smaller than the second resistance by 5 MΩ.

13. The method of determining a transfer voltage according to claim 11, wherein, in the step of switching between the first detection current and the second detection current, the first detection current is switched to the second detection current when a generated voltage generated in the transfer member upon supplying the first detection current thereto is smaller than the first switch voltage.

14. The method of determining a transfer voltage according to claim 11, wherein, in the step of switching between the first detection current and the second detection current, the second detection current is switched to the first detection current when a generated voltage generated in the transfer member upon supplying the second detection current thereto is larger than the second switch voltage.

15. The method of determining a transfer voltage according to claim 7, further comprising the step of referring to a transfer table according to the generated voltage so that the transfer voltage is determined according to the transfer table.

16. The method of determining a transfer voltage according to claim 7, further comprising the step of storing the one of the first detection current and the second detection current in a storage unit.

17. The method of determining a transfer voltage according to claim 7, further comprising the step of determining a use environment of the image forming apparatus so that the one of the first detection current and the second detection current is selected according to the use environment of the image forming apparatus.

18. The method of determining a transfer voltage according to claim 7, wherein, in the step of selecting one of the first detection current and the second detection current, said first detection current is smaller than the second detection current.

19. The method of determining a transfer voltage according to claim 7, further comprising the step of maintaining the transfer voltage at a specific level when the image forming apparatus performs a continuous printing operation.

* * * * *